US010150204B2

(12) United States Patent
Baratti

(10) Patent No.: US 10,150,204 B2
(45) Date of Patent: Dec. 11, 2018

(54) ABRASIVE TOOL FOR MACHINING SURFACES

(71) Applicant: Paolo Baratti, Concordia Sulla Secchia (IT)

(72) Inventor: Paolo Baratti, Concordia Sulla Secchia (IT)

( * ) Notice: Subject to any disclaimer, the term of this patent is extended or adjusted under 35 U.S.C. 154(b) by 84 days.

(21) Appl. No.: 15/315,773

(22) PCT Filed: Jun. 3, 2015

(86) PCT No.: PCT/IB2015/054201
§ 371 (c)(1),
(2) Date: Dec. 2, 2016

(87) PCT Pub. No.: WO2015/186076
PCT Pub. Date: Dec. 10, 2015

(65) Prior Publication Data

US 2017/0106501 A1 Apr. 20, 2017

(30) Foreign Application Priority Data

Jun. 4, 2014 (IT) ..... MO2014A0000163

(51) Int. Cl.
*B24D 9/04* (2006.01)
*B24D 9/08* (2006.01)
*B24D 11/02* (2006.01)

(52) U.S. Cl.
CPC ..... *B24D 9/04* (2013.01); *B24D 9/08* (2013.01); *B24D 11/02* (2013.01)

(58) Field of Classification Search
CPC ..... B24D 9/04; B24D 11/00; B24D 15/04; B24B 37/22; B24B 37/24; B24B 37/26
USPC ..... 451/533, 548
See application file for complete search history.

(56) References Cited

U.S. PATENT DOCUMENTS 2,174,902 A * 10/1939 Stratford ..... B24D 9/08 451/510
2,226,553 A * 12/1940 Cross ..... A47L 13/16 451/533
2,320,139 A * 5/1943 Kirchner ..... A47L 13/286 451/533

(Continued)

FOREIGN PATENT DOCUMENTS

DE DD 95332 A1 1/1973
EP 0875342 A2 11/1998

(Continued)

OTHER PUBLICATIONS

International Search Report and Written Opinion dated Dec. 9, 2015 issued in PCT/IB2015/054201.

*Primary Examiner* — George Nguyen
(74) *Attorney, Agent, or Firm* — Scully, Scott, Murphy & Presser, P.C.

(57) ABSTRACT

An abrasive tool for machining surfaces, which comprises a support associated with at least one abrasive layer, and a first layer and a second layer, both of which are made of elastically deformable material and are interposed between said support and said abrasive layer; the second layer has a higher stretch modulus than the first layer and is arranged in an intermediate position between the first layer and the abrasive layer, and the first layer is associated with the support.

14 Claims, 4 Drawing Sheets

(56) References Cited

U.S. PATENT DOCUMENTS

| | | | | | |
|---|---|---|---|---|---|
| 3,653,859 | A * | 4/1972 | Zimmer, Jr. | B24D 11/00 | 451/533 |
| 3,732,652 | A * | 5/1973 | Furgal | A47L 13/16 | 451/533 |
| 4,893,439 | A * | 1/1990 | McAvoy | B24D 11/001 | 15/230 |
| 5,138,735 | A * | 8/1992 | Kusz | B24D 9/085 | 15/230 |
| 5,383,309 | A * | 1/1995 | Sampietro | B24D 9/08 | 451/533 |
| 5,573,453 | A * | 11/1996 | Tiefenbach, Jr. | B24D 3/28 | 451/533 |
| 5,775,984 | A * | 7/1998 | Olson | B24D 9/085 | 451/532 |
| 6,458,018 | B1 * | 10/2002 | Goers | B24B 7/241 | 451/41 |
| 2002/0002027 | A1 | 1/2002 | Eppert, Jr. et al. | | |
| 2008/0064311 | A1 * | 3/2008 | Suzuki | B24B 37/26 | 451/527 |
| 2008/0233837 | A1 * | 9/2008 | Annen | B24B 1/00 | 451/37 |
| 2013/0157552 | A1 * | 6/2013 | Kolthoff | B24D 9/08 | 451/548 |

FOREIGN PATENT DOCUMENTS

| | | | |
|---|---|---|---|
| EP | 1177860 | A1 | 2/2002 |
| WO | WO 2008/116043 | A1 | 9/2008 |

* cited by examiner

ABRASIVE TOOL FOR MACHINING SURFACES

The present invention relates to an abrasive tool for machining surfaces.

Abrasive tools are known for surface grinding, both rough and fine, which usually have a layer of aggregated abrasive granules which is associated with a support that has a different rigidity as a function of the machining to be performed, so as to obtain a more or less deformable support of the abrasive support. Such tools can be of the manual type or of the type used on machines, such as orbital sanders, drills or finishing machines, which have a motorized rotating shaft associated with a "backing pad" which is constituted by a rigid support and by an elastically yielding layer (sponge) which are coupled together; the yielding layer can be mated with an abrasive layer by the interposition of Velcro®, so as to be able to easily replace the abrasive layer in the event of wear.

Such backing pads are categorized as "hard", "medium" or "soft" as a function of the stretch modulus of the sponge layer.

For example in order to execute the facing of surfaces that are contoured, concave or convex, and coated with putties, undercoats, paints, gelcoat, glass fibers or the like, according to the current operating method, in order to prevent the formation of "undulations", i.e. surface imperfections, usually an initial machine roughing in performed using a hard or medium backing pad, which however does not define precise outlines and leaves steps on the machined surface, because soft backing pads would not allow an adequate removal of material owing to the low resistance offered by the support. Then a step of manual roughing is performed using pre-shaped or flexible pads, which is often followed by a step of finishing in order to remove the scratches and marks left by the manual roughing, which can be carried out by hand using finer abrasives or by machine by way of a soft backing pad or the addition of an intermediate soft layer between the hard backing pad and the abrasive disk.

This conventional operating method is not devoid of drawbacks, among which is the fact that it has to be carried out in several passes, involving not insignificant execution times, and they require the availability of several different tools and devices, both manual and automatic.

In particular, in order to carry out the manual roughing, tools may be required which are differently shaped from the shape of the surface being machined, in order to prevent the formation of surface undulations. Furthermore, between the first roughing by machine and the finishing, the backing pad in use must be replaced or in any case a soft intermediate layer must be inserted, with consequent times for setting up the equipment.

Also, the step of manual roughing, if not carried out by trained personnel, can involve lengthy execution times and make the subsequent step of finishing burdensome, if many scratches and marks are made on the surface being machined.

Furthermore, the use of conventional backing pads can result in damage to the edges of the surface being machined.

The aim of the present invention is to eliminate the above mentioned drawbacks of the background art by providing an abrasive tool for machining surfaces which makes it possible to execute an optimal facing machining, without the formation of surface undulations, in a single pass and without requiring tool replacements, independently of the profile of the surface proper.

Therefore, within this technical aim, an object of the present invention is to reduce the execution times and the costs for setting up the necessary devices.

Another object of the present invention is to ensure an optimal level of finishing, independently of the degree of experience and accuracy of the operator who carries out the work.

Another object of the present invention is to not damage the edges of the surface being machined.

Another object of the present invention is to facilitate the substitution of worn parts and to optimize the flexibility of use.

Last but not least, another object of the present invention is to provide a simple structure which is easy and practical to implement, safe in use and effective in operation, and low cost.

This aim and these and other objects which will become better apparent hereinafter are all achieved by the present abrasive tool for machining surfaces, which comprises a support associated with at least one abrasive layer, characterized in that it comprises a first layer and a second layer, both of which are made of elastically deformable material and are interposed between said support and said abrasive layer, the second layer having a higher stretch modulus than the first layer and being arranged in an intermediate position between the first layer and the abrasive layer, and the first layer being associated with the support.

Further characteristics and advantages of the present invention will become better apparent from the detailed description of some preferred, but not exclusive, embodiments of an abrasive tool for machining surfaces, which are illustrated for the purposes of non-limiting example in the accompanying drawings wherein.

Figure 1:
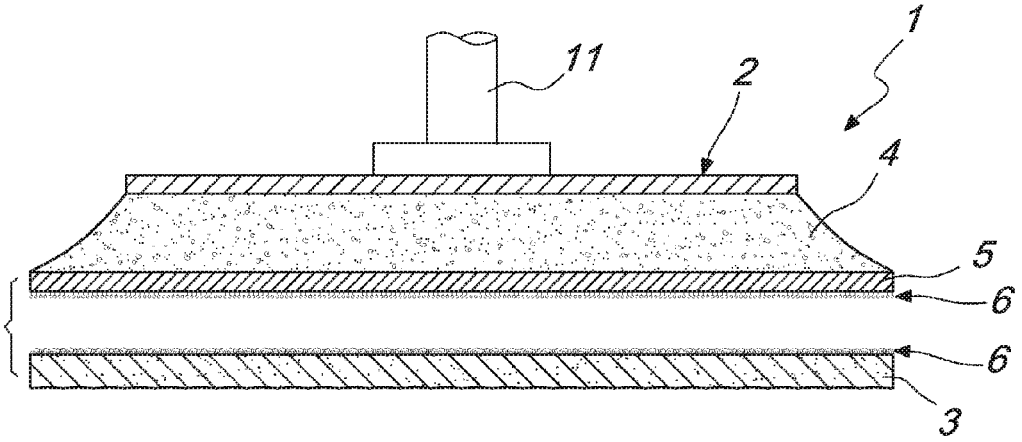
FIG. 1 is a schematic cross-sectional view of a first embodiment of an abrasive tool for machining surfaces, according to the invention.
Figure 2:
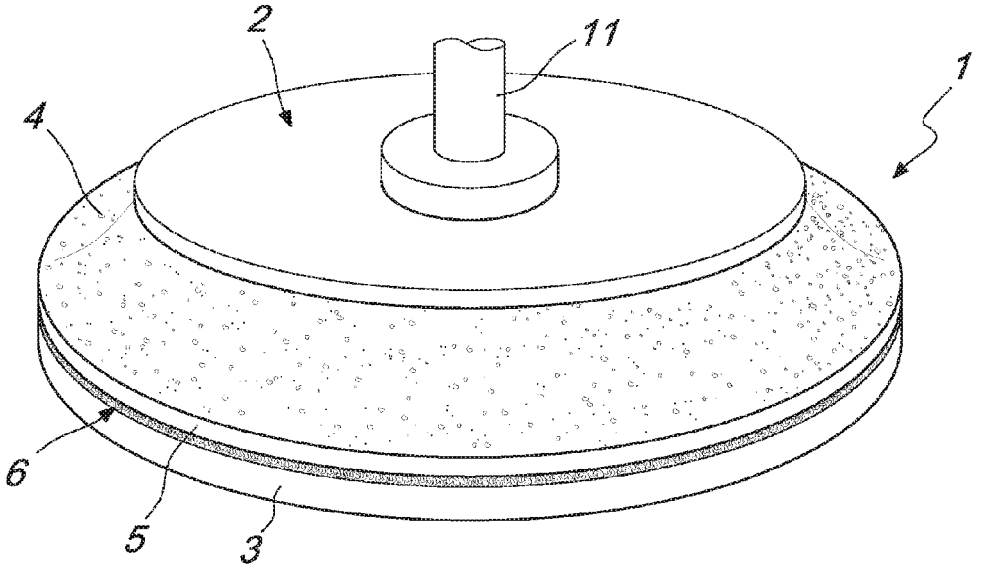
FIG. 2 is a perspective schematic view of the abrasive tool in FIG. 1.

With particular reference to the figures, the reference numeral 1 generally designates an abrasive tool for machining surfaces.

The tool 1 comprises a support 2 which is associated with an abrasive layer 3 which is constituted by a conventional sheet or disk made of aggregated abrasive granules.

The tool 1 also comprises a first layer 4 and a second layer 5 which are interposed between the support 2 and the abrasive layer 3, the second layer 5 being arranged in an intermediate position between the first layer 4 and the abrasive layer 3 and the first layer 4 being associated with the support 2.

According to the invention the second layer 5 has a greater stretch modulus than that of the first layer 4 with respect to stresses which are substantially at right angles to the plane of arrangement of the layers. In this manner, in use the second layer 5, which is less yielding and deformable than the first one, offers a suitable abutment to the abrasive layer 3 in order to obtain an optimal removal of material, while the greater deformability of the first layer 4 allows the tool 1 to follow any profile of the surface S to be machined (FIGS. 3 and 4).

Substantially, in use the second layer 5 flexes elastically, being supported by the first layer 4, which deforms as a function of the profile of the surface S to be machined.

Figure 3:
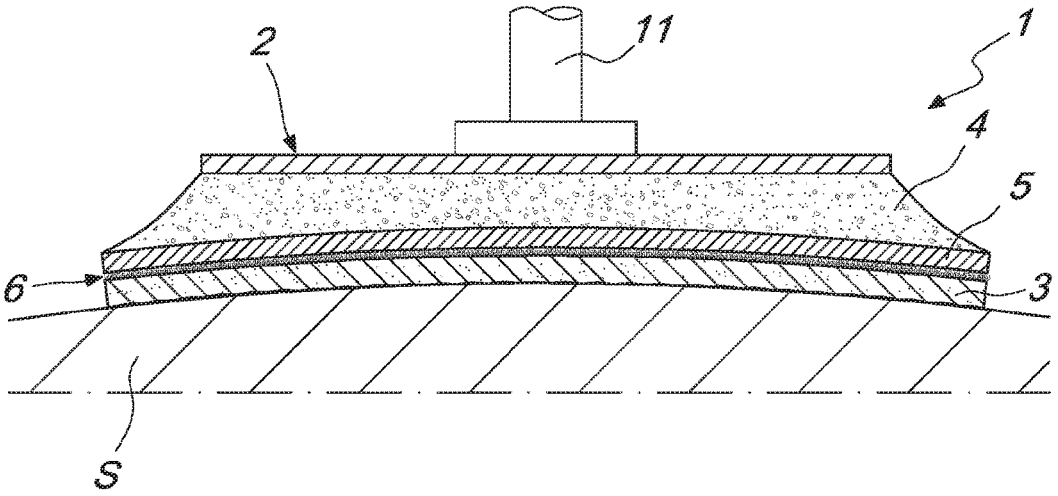
FIGS. 3 and 4 are schematic cross-sectional views of the abrasive tool in FIG. 1 during the machining of contoured surfaces.
Figure 4:
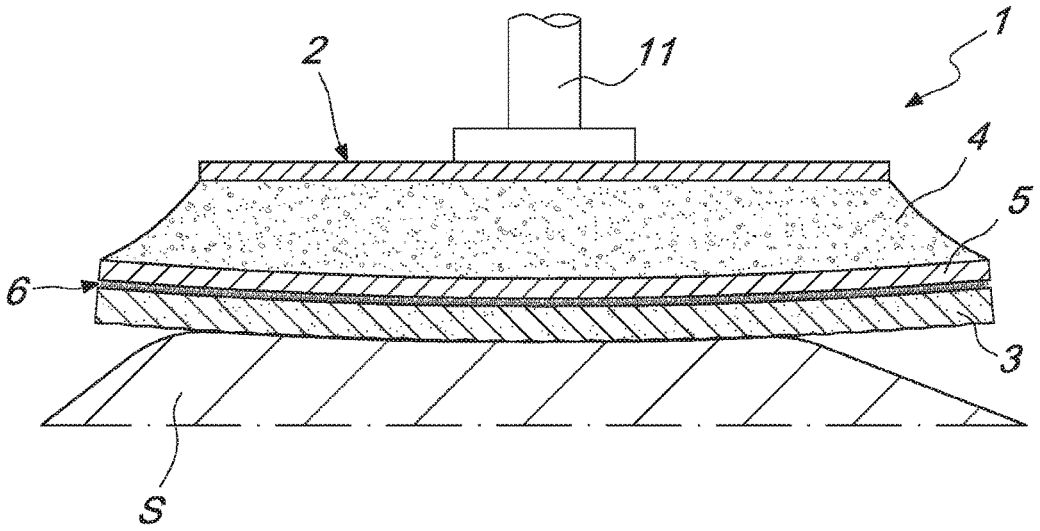

As can be seen from FIGS. 3 and 4, in fact, the first layer 3 deforms elastically, compressing and dilating in different areas, following the shape structure assumed by the second layer 5 as a result of contact with the surface S.

Furthermore, the greater rigidity of the second layer 5 prevents the tool 1 from interfering with the edges of the surface S being machined, so as not to damage them (FIG. 4) in that the deformation of the second layer 5 ensures that the abrasive layer 3 tends to move away from the edges.

In this manner the tool 1 makes it possible to execute the facing of surfaces in a single pass and with a single tool, independently of the profile of such surface, while preventing the formation of surface undulations.

For example the first layer 4 can be made with a material that has an adequate stretch modulus, so as to be yielding and compressible as a result of stresses at right angles to the arrangement of such layer. For example the first layer 4 can be made of sponge, rubber, polyurethanes or other soft material that can be sourced on the market. Alternatively the first layer 4 can be constituted by a cushion filled with air, powders or liquids of any nature.

The second layer 5 can be constituted by a metallic plate made of steel or the like, of composite fibers, plastics, rigid rubber or other material with suitable stretch modulus which can be sourced on the market. In particular the second layer 5 must be elastically flexible to a stress applied at right angles to its plane of arrangement.

Preferably the second layer 5 is 0.2 mm thick and is made with a metallic plate with a Vickers hardness of the order of magnitude of 444 HV 1 and a flexing stretch modulus of the order of magnitude of 220 GPa.

The second layer 5 can have, more generally, a thickness comprised between 1 μm and 1 cm.

It should be noted that the second layer 5 is provided seamlessly in a single piece, and its extent in plan view is comparable to that of the abrasive layer 3, so as to give uniform support to the latter.

Furthermore, the adhesion surfaces of the layers 4 and 5 substantially coincide. Alternatively the first layer 4 can have a greater extent than the second layer 5, up to 25%.

In this manner the abrasive layer 3 can be optimally supported by distributing the reaction of the second layer 5 on the first layer 4.

Preferably the tool 1 is intended to be used in conventional orbital sanders, drills or the like and the corresponding support 2 is provided with means of coupling with the motorized shaft of the drill, of the type of a shank 11 or a groove. In this case the tool 1 can be used as a conventional backing pad. For this reason the tool 1 is shown as being circular in plan view, but alternative embodiments are possible which have different geometries. In addition the tool 1 can be perforated in order to allow the suction of the dust formed during the machining as in use on the market.

However, the possibility is not excluded of providing a tool 1 which is intended for manual use, in which the support 2 is contoured for gripping by the operator.

In a first embodiment (FIGS. 1-4), the support 2, the first layer 4 and the second layer 5 are coupled stably so as to adhere to each other by way of interposition of adapted conventional adhesives, while detachable coupling means 6 are provided between the second layer 5 and the abrasive layer 3, so as to be able to replace them in the event of depletion or damage, or in order to change the type of machining.

Alternatively, the abrasive layer 3 can also adhere stably to the second layer 5.

The detachable coupling means 6 can be constituted by elements made of Velcro® which cover the entire adhesion surface between the second layer 5 and the abrasive layer 3 or part thereof. Alternatively, adapted reversible interlocking systems can be provided.

Figure 5:
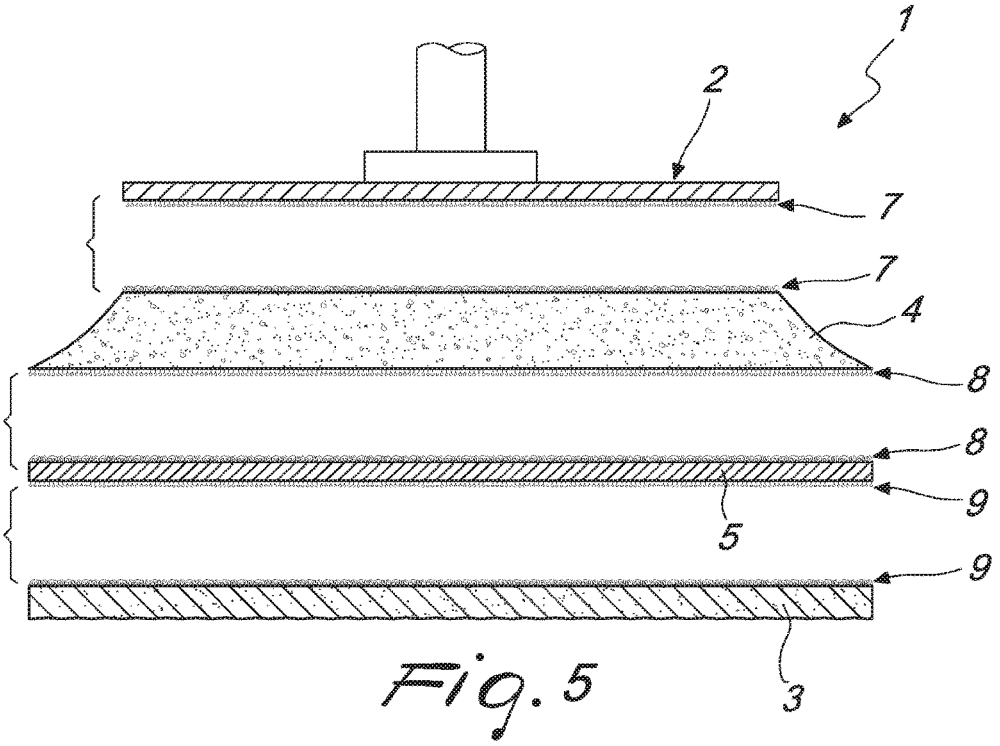
FIG. 5 is a schematic cross-sectional view of a second embodiment of the abrasive tool, according to the invention.

In a second embodiment (FIG. 5), the tool 1 can be dismantled completely and detachable coupling means 7, 8 and 9 are provided respectively between the support 2 and the first layer 4, between the first layer 4 and the second layer 5 and between the second layer 5 and the abrasive layer 3.

The detachable coupling means 7, 8, 9 can be constituted by elements made of Velcro® which cover the entire adhesion surface or part thereof. Alternatively, adapted reversible interlocking systems can be provided.

In this manner any component part can be replaced independently of the others and without dismounting the support 2 from the machine tool.

Furthermore the flexibility of use of the tool 1 can be optimized, since the stretch modulus and the thickness of the first layer 4 can be freely selected.

Figure 6:
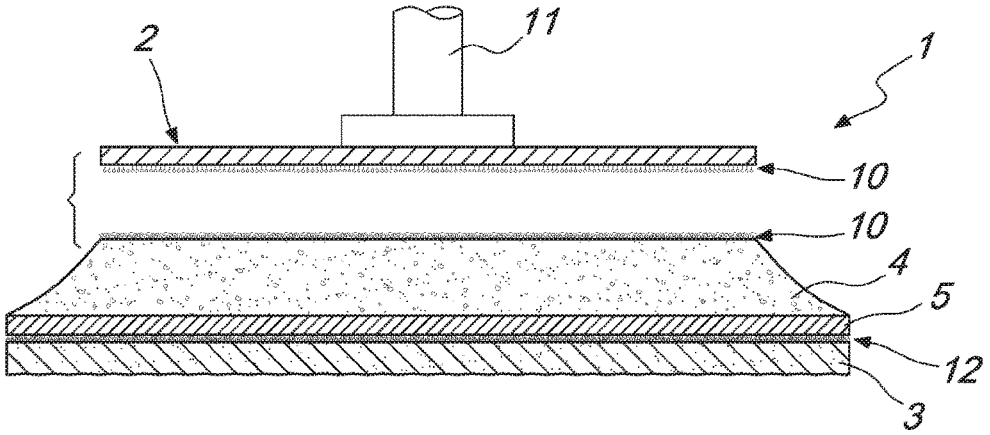
FIG. 6 is a schematic cross-sectional view of a third embodiment of the abrasive tool, according to the invention.

In a third embodiment (FIG. 6) the first layer 4 and the second layer 5 are coupled stably so as to adhere to each other by way of interposition of conventional adhesives and detachable coupling means 10 and 12, respectively, are provided between the support 2 and the first layer 4 and between the second layer 5 and the abrasive layer 3.

In this case the first layer 4 and the second layer 5 constitute an intermediate cushion to be interposed between a conventional support 2 for a backing pad and the abrasive layer 3.

The detachable coupling means 10 and 12 can be constituted by elements made of Velcro® which cover the entire adhesion surface or part thereof. Alternatively, adapted reversible interlocking systems can be provided.

Figure 7:
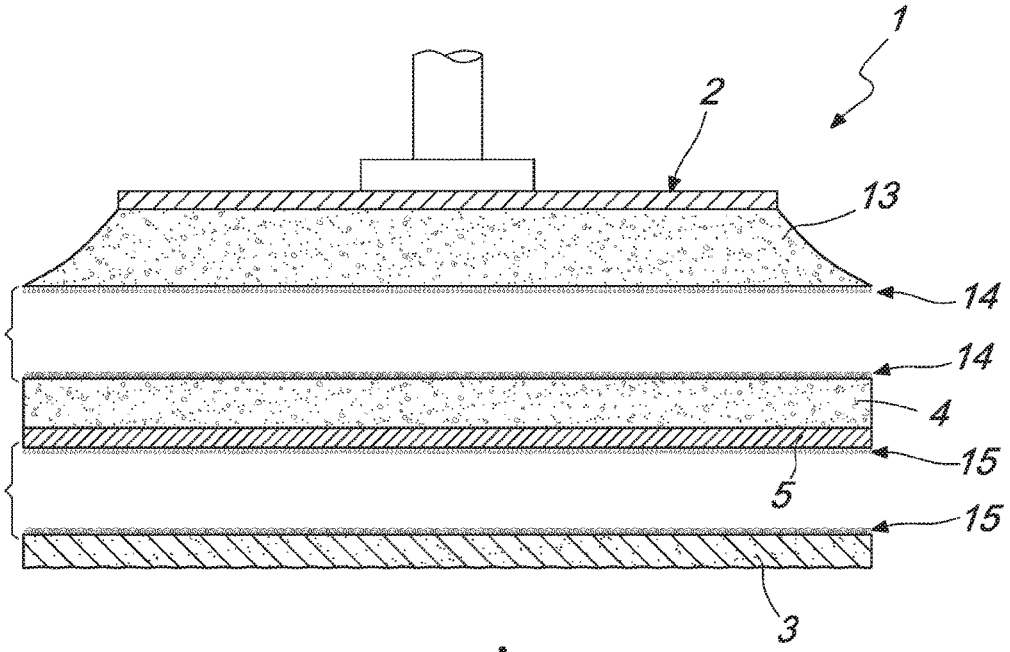
FIG. 7 is a schematic cross-sectional view of a fourth embodiment of the abrasive tool, according to the invention.

FIG. 7 shows a fourth embodiment, which is a variation of the preceding one, in which the intermediate cushion constituted by the layers 4 and 5 is interposed between a conventional backing pad constituted by a support 2 and an elastically yielding layer 13.

In this case detachable coupling means 14 and 15, respectively, are provided between the elastically yielding layer 13 and the first layer 4 and between the second layer 5 and the abrasive layer 3.

The detachable coupling means 14 and 15 can be constituted by elements made of Velcro® which cover the entire adhesion surface or part thereof. Alternatively, adapted reversible interlocking systems can be provided.

Figure 8:
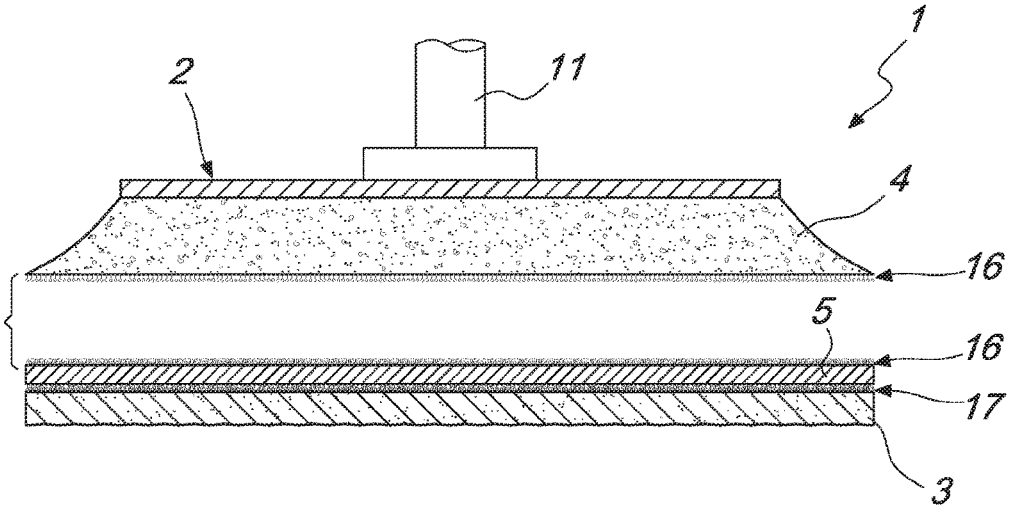
FIG. 8 is a schematic cross-sectional view of a fifth embodiment of the abrasive tool, according to the invention.

In a fifth embodiment (FIG. 8) the support 2 and the first layer 4 are coupled stably so as to adhere to each other, by way of interposition of conventional adhesives, so as to constitute a conventional backing pad and detachable coupling means 16 and 17, respectively, are provided between the first layer 4 and the second layer 5 and between the second layer 5 and the abrasive layer 3.

In this manner the second layer 5 constitutes an insert that can be applied to a conventional soft backing pad, constituted by a support 2 and a first layer 4, in order to obtain an optimal facing in a single pass.

The detachable coupling means 16 and 17 can be constituted by elements made of Velcro® which cover the entire adhesion surface or part thereof. Alternatively, adapted reversible interlocking systems can be provided.

In a further embodiment, not shown, the abrasive layer 3 and the second layer 5 are coupled stably so as to adhere to each other, by way of interposition of conventional adhesives, while between the second layer 5 and the first layer 4 there are detachable coupling means of the type described above. The first layer 4 can be directly coupled to the support 2 or there can be a further yielding layer as in FIG. 7.

Furthermore the first layer 4, the second layer 5 and the abrasive layer 3 can be coupled stably so as to adhere to each other, by way of interposition of conventional adhesives, and the first layer 4 can be coupled to the support 2 directly or by way of interposition of a further yielding layer as in FIG. 7 by way of detachable coupling means of the type described above.

In practice it has been found that the invention as described achieves the intended aim and objects and, in particular, attention is drawn to the fact that the tool according to the invention makes it possible to quickly and economically execute the facing of surfaces, howsoever shaped, and without leaving surface undulations.

Furthermore the tool according to the invention can be provided especially or obtained from conventional backing pads by way of the addition of accessory elements.

The invention, thus conceived, is susceptible of numerous modifications and variations, all of which are within the scope of the appended claims.

For example the possibility is not ruled out that the tool according to the invention can have one or more additional layers, including layers made of different materials, such as for example a layer of rubber between the second layer and the means for detachable coupling to the abrasive layer.

Moreover, all the details may be substituted by other, technically equivalent elements.

In practice the materials employed, as well as the contingent dimensions and shapes, may be any according to requirements without for this reason departing from the scope of protection claimed herein.

The content of Italian patent application no. MO2014A000163, the priority of which is claimed in the present application, is incorporated as a reference.

The invention claimed is:

1. An abrasive tool for machining surfaces, which comprises a support associated with at least one abrasive layer, comprising a first layer and a second layer, both of which are elastically deformable and are interposed between said support and said abrasive layer, the second layer having a higher stretch modulus than the first layer and being arranged in an intermediate position between the first layer and the abrasive layer, and the first layer being associated with the support.

2. The tool according to claim 1, wherein said second layer comprises a lamina made of metal, of composite fibers, plastics or rigid rubber.

3. The tool according to claim 1, wherein said first layer is made of sponge, polyurethanes, rubber or from a cushion containing fluids or powders.

4. The tool according to claim 1, wherein said second layer is provided seamlessly in a single piece and its extent in plan view is comparable to that of the abrasive layer.

5. The tool according to claim 1, wherein an adhesion surface between said first layer and said second layer is at least equal to an extent in plan view of said second layer.

6. The tool according to claim 1, wherein said support comprises means for coupling to a rotating shaft of an automatic machine tool.

7. The tool according to claim 1, wherein said first layer and said second layer and said support are coupled stably so as to adhere to each other, detachable coupling means being provided between the second layer and the abrasive layer.

8. The tool according to claim 1, wherein said abrasive layer and said first layer and said second layer are coupled stably so as to adhere to each other, detachable coupling means being provided between said support and said first layer.

9. The tool according to claim 1, wherein said abrasive layer and said second layer are coupled stably so as to adhere to each other, detachable coupling means being provided between said second layer and said first layer.

10. The tool according to claim 1, wherein detachable coupling means are provided between the support and the first layer, between the first layer and the second layer and between the second layer and the abrasive layer.

11. The tool according to claim 1, wherein said first layer and said second layer are coupled stably so as to adhere to each other, detachable coupling means being provided between the support and the first layer and between the second layer and the abrasive layer.

12. The tool according to claim 1, wherein said first layer and said second layer are coupled stably so as to adhere to each other and further comprising an elastically yielding layer which is stably coupled to said support, detachable coupling means being provided between the elastically yielding layer and the first layer and between the second layer and the abrasive layer.

13. The tool according to claim 1, wherein said first layer and said support are coupled stably so as to adhere to each other, detachable coupling means being provided between the first layer and the second layer and between the second layer and the abrasive layer.

14. The tool according to claim 7, wherein said detachable coupling means comprise Velcro® or reversible interlocking systems.

* * * * *